US006622322B1

(12) United States Patent
Caveney

(10) Patent No.: US 6,622,322 B1
(45) Date of Patent: Sep. 23, 2003

(54) CRIB SIDE RAIL

(75) Inventor: Jack E. Caveney, Hinsdale, IL (US)

(73) Assignee: Panduit Corp., Tinley Park, IL (US)

( * ) Notice: Subject to any disclaimer, the term of this patent is extended or adjusted under 35 U.S.C. 154(b) by 34 days.

(21) Appl. No.: 09/655,528

(22) Filed: Sep. 5, 2000

(51) Int. Cl.[7] ..... A47D 7/02
(52) U.S. Cl. ..... 5/100; 5/93.1; 5/428
(58) Field of Search ..... 5/93.1, 100, 424, 5/425, 428

(56) References Cited

U.S. PATENT DOCUMENTS

| | | | |
|---|---|---|---|
| 1,345,485 | A | 7/1920 | Foster |
| 1,371,607 | A | 3/1921 | Doty |
| 1,592,573 | A | 7/1926 | Soans |
| 1,596,243 | A | 8/1926 | Dyke |
| 1,618,447 | A | 2/1927 | Kusterle |
| 2,282,484 | A | 5/1942 | Kroll et al. |
| 2,447,722 | A | 8/1948 | Webb |
| 2,635,257 | A | 4/1953 | Kroll |
| 3,135,973 | A | 6/1964 | Spencer |
| 3,862,455 | A | 1/1975 | Turski |
| 4,413,365 | A | 11/1983 | Flye et al. |
| 4,825,482 | A * | 5/1989 | Paris ..... 5/100 |

* cited by examiner

*Primary Examiner*—Teri Pham Luu
*Assistant Examiner*—Fredrick Conley
(74) *Attorney, Agent, or Firm*—Robert A. McCann; Jay A. Saltzman; Christopher S. Clancy

(57) ABSTRACT

A crib including a pair of endwalls and a pair of sidewalls, at least one of the sidewalls being descendable to facilitate placing a child into and removing the child from the crib over the descendable sidewall. The descendable sidewall has opposed ends, one of which adjoins one of the pair of endwalls and the other of which adjoins the other of the pair of endwalls. The crib further includes a leg-disposed proximately toward the descendable sidewall adjoins the one of the pair of endwalls and a leg disposed proximately to where the descendable sidewall adjoins the other of the pair of endwalls. The legs support the crib above a generally flat surface and provide clearance between the crib and the generally flat surface, such that the descendable sidewall is descendable toward the flat surface relative to the endwalls. The crib further includes a crib side rail for slidably supporting the descendable sidewall of the crib thereon between the endwalls. The crib side rail is securely retained relative to the endwall by having a portion thereof disposed through an aperture in the endwall and by having a rear portion thereof bent behind the aperture.

11 Claims, 6 Drawing Sheets

CRIB SIDE RAIL

BACKGROUND OF THE INVENTION

There are few, if any, consumer products for which safety is of more importance than a crib. A crib is the primary place where infants and toddlers spend unsupervised time, and, as such, it is critical for cribs to be designed to prevent any significant chance of injury or death to their young inhabitants.

Despite increasing standardization and regulation relating to the design and manufacture of cribs, significant hazards still exist. Recently, the U.S. Consumer Product Safety Commission (CPSC), whose function it is to protect the public from unreasonable risks of injury and death due to consumer products, issued a document (#5025) declaring that it is concerned about having received reports of numerous incidents in which cribs have come apart, resulting in injuries and death. The document cites three examples of reported mechanical failure in cribs. Two of these examples pertain to the failure of a screw or bolt securing the side rail of the crib to the corner post or headboard of the crib. These failures resulted in the side rail becoming spaced from the mattress and the young child choking or suffocating to death after becoming entrapped in the resulting space. According to the document, similar reports of fatal accidents are repeated many times in CPSC files, and many more nonfatal incidents are on record in which an entrapped child was rescued.

SUMMARY OF THE INVENTION

To address the problems identified with regard to crib construction generally, and more particularly with respect to securing the attachment of a crib side rail to a corner post, headboard, or endwall, an inventive crib side rail is presented. A redesigned guide rail and/or mounting apparatus inhibits the type of failure exemplified in the above-recited CPSC document and will save infants and toddlers from death and serious injuries.

In one embodiment of the invention, there is presented a crib including a pair of endwalls and a pair of sidewalls. At least one of the sidewalls is descendable to facilitate placing a child and removing the child from the crib over the descendable sidewall. The descendable sidewall has opposing ends, one of the opposing ends adjoining one of the pair of endwalls and the other of the opposing ends adjoining the other of the pair of endwalls. The crib also includes a leg disposed proximately to where the descendable sidewall adjoins the one of the pair of endwalls and a leg disposed proximately to where the descendable sidewall adjoins the other of the pair of endwalls. The legs support the crib above a generally flat surface and provide clearance between the crib and the generally flat surface such that the descendable sidewall is descendable toward the flat surface relative to the endwalls. The crib further includes a crib side rail for slidably supporting the descendable sidewall of the crib thereon between the endwalls. The crib side rail is securely retained relative to the endwall by having a portion thereof disposed through an aperture in the endwall and by having a rear portion thereof bent behind the aperture.

In another embodiment of the invention, there is presented a method for assembling a crib. The method includes the steps of providing a generally bent rail having a rear portion and at least one end portion generally perpendicular to the rear portion, providing an endwall having an aperture therethrough suitably sized to receive the rail therethrough, the endwall having a leg extending therefrom, providing a sidewall having at least one aperture therethrough suitably sized to receive the rail therethrough, and providing a mounting bracket. The method also includes the step of inserting the end portion of the rail through the aperture of the endwall. The method also includes the step of sliding the end portion of the rail through the aperture until the rear portion of the rail attains a predetermined distance from the endwall and is generally parallel thereto. The method also includes the step of bending the end portion of the rail approximately 90° such that it is generally parallel to the leg. The method also includes the step of aligning the sidewall aperture with the bent end portion of the rail. The method also includes the step of threading the sidewall onto the bent end portion of the rail. The method also includes the step of translating the mounting bracket along the leg, and then simultaneously along the leg and the bent end portion of the rail. The method also includes the step of affixing the mounting bracket relative to the leg.

In yet another embodiment of the invention, there is presented a crib including a pair of endwalls and a pair of sidewalls extending between the endwalls. Each of the sidewalls is descendable to facilitate placing a child into and removing the child from the crib over one of the descendable sidewalls. A leg is disposed proximately to where each descendable sidewall adjoins each endwall. The legs are for supporting the crib above a generally flat surface and for providing clearance between the crib and the generally flat surface such that the descendable sidewalls are descendable toward the flat surface relative to the endwalls. The crib further includes a pair of crib side rails for slidably supporting the descendable sidewalls of the crib thereon between said endwalls. Each of the pair of crib side rails is associated with one of the pair of endwalls such that it is retained between a pair of apertures therein. Each of the crib side rails has a central portion retained behind the associated endwall, a pair of retention portions retained in the apertures of the associated endwall, and a pair of end portions each for slidably supporting one end of the descendable sidewalls.

DETAILED DESCRIPTION OF PREFERRED EMBODIMENTS

Figure 1:
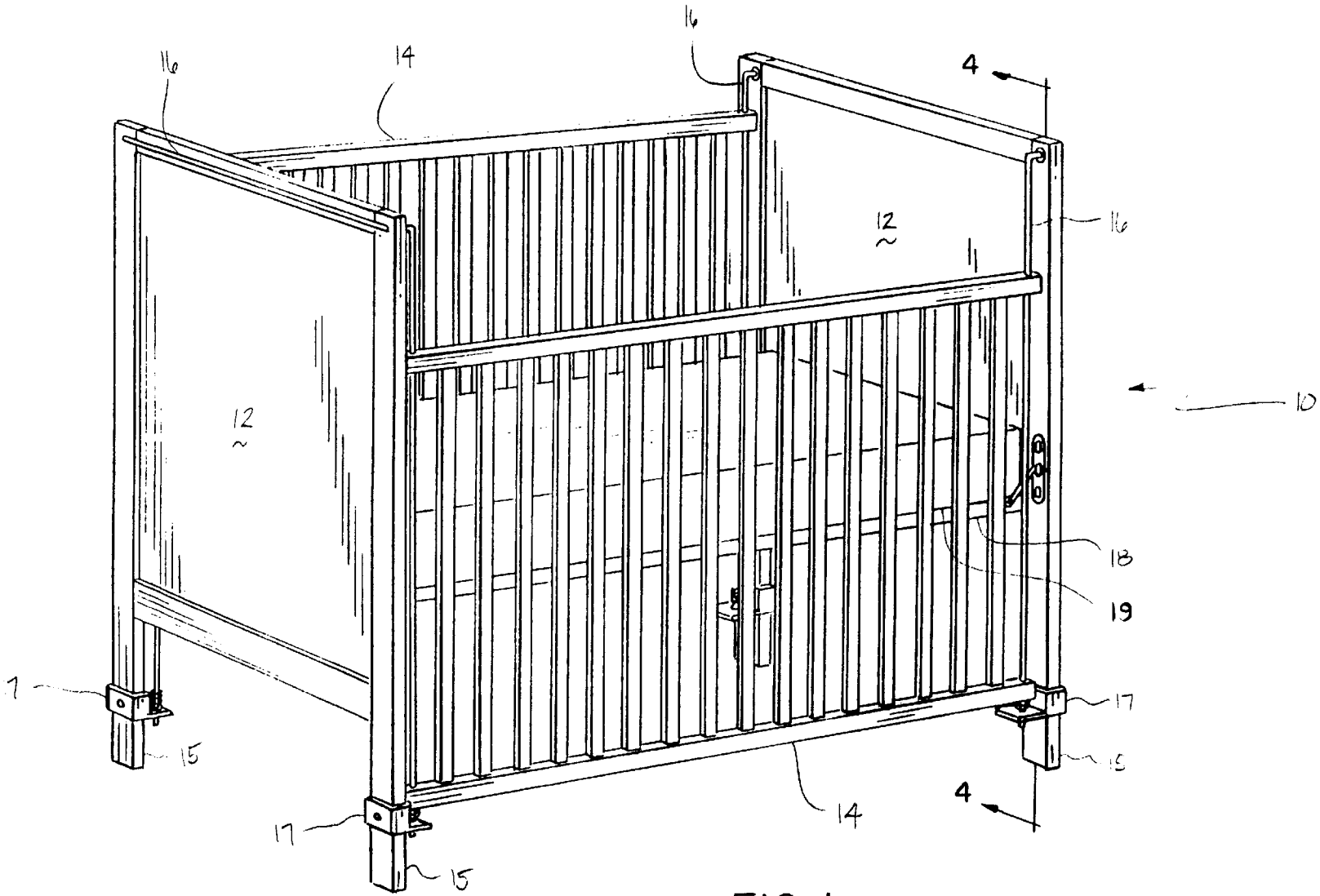
FIG. 1 is a perspective view of a crib in accordance with an embodiment of the invention.

FIG. 1 is a perspective view of a crib in accordance with an embodiment of the invention. The crib 10 is generally rectangular and includes a pair of opposed endwalls 12 and a pair of opposed sidewalls 14. The endwalls may be different from one another or the crib may be asymmetric, such that one of the endwalls is intended to serve as a headboard while the other of the endwalls is intended to serve as a footboard, or no preference for orientation may be indicated by the construction of the crib. Also, the endwalls and sidewalls may be solid, slatted or of any other typical construction. In the embodiment illustrated in FIG. 1, no distinction is shown between the two solid, integral endwalls nor between the slatted sidewalls. In general with respect to the invention, one or both of the sidewalls may be descendable upon one or more side rails 16. In the embodiment illustrated in FIG. 1, both of the sidewalls are descendable relative to the endwalls.

The crib 10 is supported off the floor or other flat surface by legs 15 which may or may not be integral with the endwalls 12. In the embodiment illustrated in FIG. 1, the legs 15 are integral with the endwalls 12. Mounting brackets 17 may be used on the legs 15 to support and/or provide descent limitation to the descendable sidewalls 14. Supported from the endwalls 12 is a generally horizontal mattress support 18 for supporting a mattress 19 thereon. Thus, the crib 10 is intended as a place for infants and toddlers to sleep and sometimes play or engage in other activities while supported on the mattress. In general, at least one of the sidewalls is descendable to facilitate placing a child into the crib and removing the child from the crib over the descendable sidewall when it is in a descended position. The descendable sidewalls then are raisable to insure that the child does not escape the crib and thereby injure himself. As compared with prior art crib designs, the inventive crib provides a safer environment, less prone to mechanical failure, thereby better insuring the safety of the child residing therein.

Figure 2A:
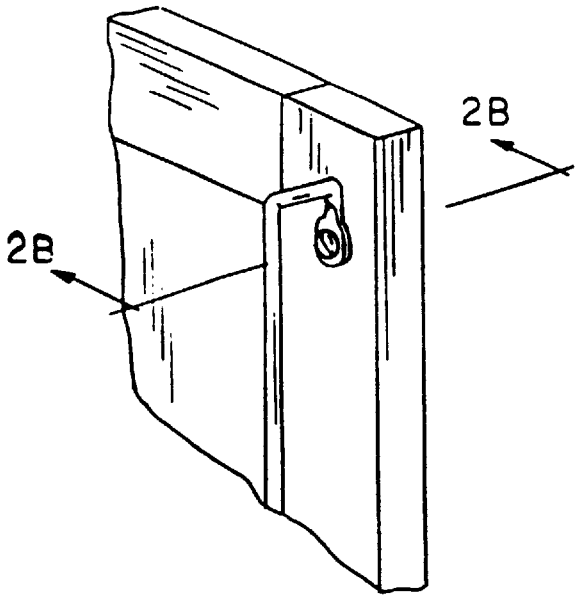
PRIOR ART FIG. 2A
FIG. 2*a* is a perspective view of a first type of crib side rail connection known in the prior art.
Figure 2B:
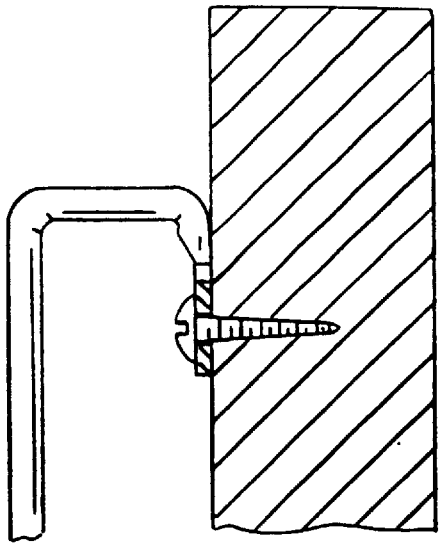
PRIOR ART FIG. 2B
FIG. 2*b* is a side view of the connection of FIG. 2*a;*

FIGS. 2 and 3 depict prior art designs for securing a crib side rail to an end wall. FIGS. 2*a* and 2*b* show a crib side rail having a flat flange with an aperture therethrough alignable with a threaded aperture in the endwall such that a screw or appropriate other fastener may be collinearly inserted through both apertures to secure the side rail flush against the inner surface of the headboard. In addition to the provided figures, U.S. Pat. Nos. 3,135,973 and 4,413,365 show such flanged connections.

Figure 3A:
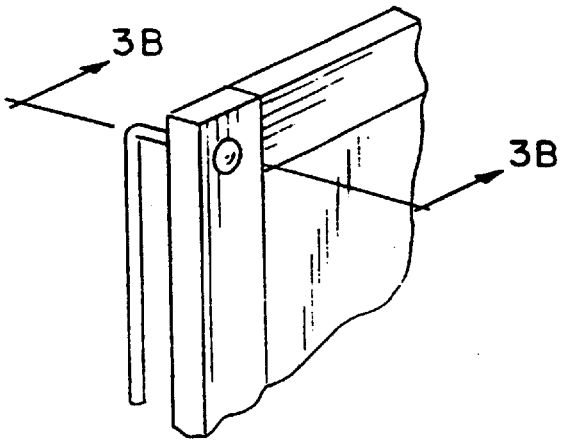
FIG. 3*a* is a perspective view of a second type of crib side rail connection known in the prior art.
Figure 3B:
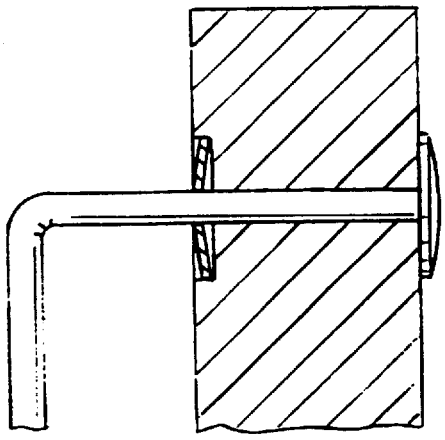
FIG. 3*b* is a side view of the connection of FIG. 3*a;*

FIGS. 3*a* and 3*b* show a crib side rail extending through the thickness of the endwall and having a head portion at the end thereof for coming flush with the outer surface of the endwall to prevent the side rail from being pulled out through the aperture. A washer may also be used on the inner surface of the endwall or in a recess on the inner surface of the endwall to better secure the side rail as it emerges from the endwall. In addition to the provided figures, U.S. Pat. Nos. 1,345,485; 1,618,447; and 2,282,484 show such connections.

These prior art designs are prone to failure in the manner described above and referenced in U.S. Consumer Products Safety Commission Document No. 5025. In particular, both of these designs have relatively high risk of mechanical failure which can result in the crib side rail pulling away from the endwall. The design of FIGS. 2 could fail, for example, if the screw became loose, which screws often do over time, or if the head of the screw were sheared or torqued off the body of the screw. As the crib rail may well be subjected to oblique forces during the manual descending and/or raising of the sidewall, these forces would potentially introduce stresses on the prior art connections that could cause failure. Similarly, with the design of FIGS. 3, the head portion retaining the crib side rail flush against the outer surface of the endwall could easily be induced to fail from high crib rail stresses or from defective head portion design. The inventive crib side rail design is intended to substantially ameliorate the risk of these types of failures and the resulting hazardous conditions created thereby.

Figure 5:
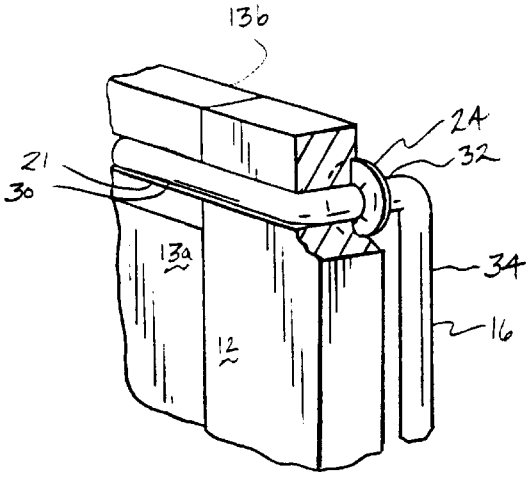
FIG. 5 is a broken perspective view of the crib side rail connection in the embodiment of FIG. 1.
Figure 6:
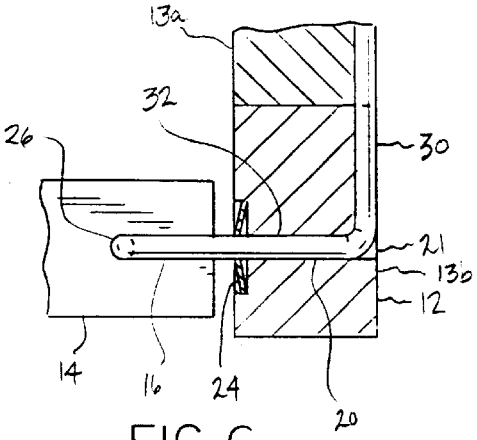
FIG. 6 is a broken top cross-sectional view of the crib side rail connection of FIG. 4 taken along line 6—6 in FIG. 4.
Figure 4:
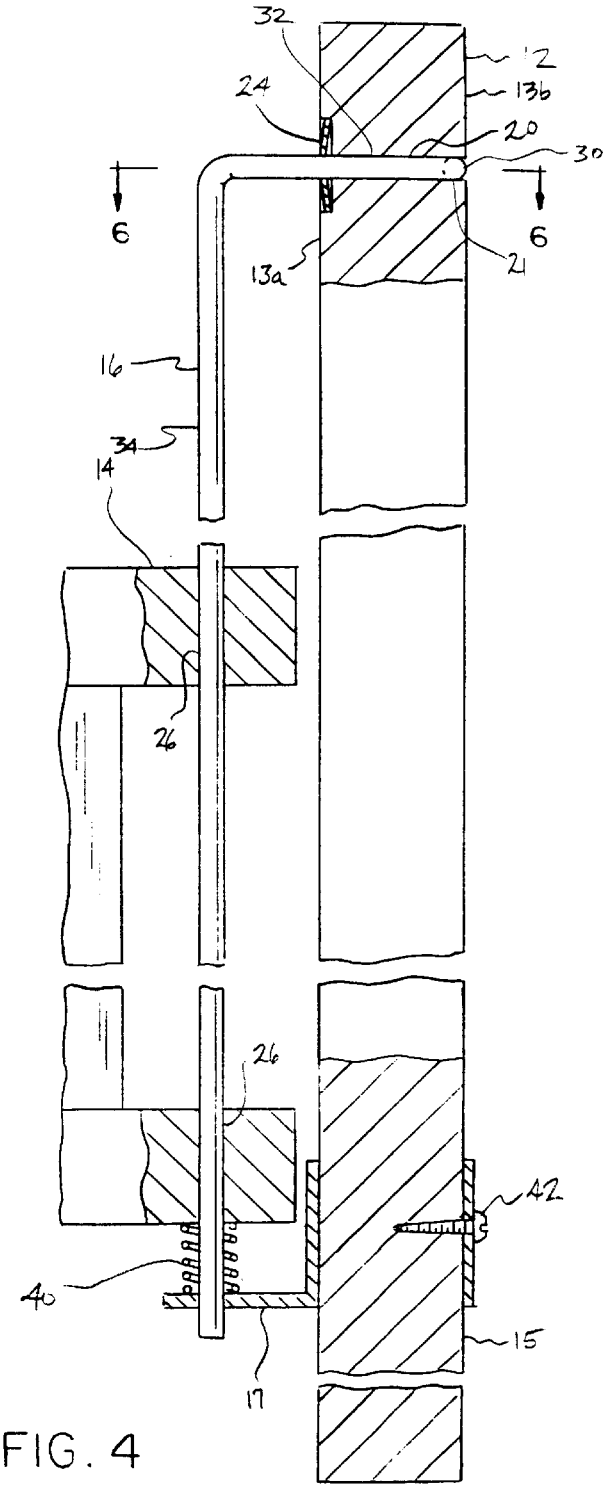
FIG. 4 is a broken front sectional view of one end of the crib of FIG. 1, taken along the line 4—4 in FIG. 1.

The securement of the side rail 16 to the endwall 12 in the inventive crib is best shown in detail in FIGS. 4–6, and more generally in FIG. 1. In particular, the side rail 16, when fully installed, has a central portion 30 which preferably resides in a groove 21 on the outer surface 13*b* of the endwall 12. Adjacent the central portion, the side rail has relatively shorter retention portions 32 on either side of the central portion 30. The retention portions 32 extend through apertures 20 and 22 (FIG. 8) in the endwall 12. Extending further outward on the side rail 16, adjacent each of the retention portions 32 is a longer end portion 34 on which the descendable sidewalls are supported. Thus, a single side rail 16 can be used to support one side of two distinct opposing descendable sidewalls 14 because the side rail 16 traverses the width of the endwall 12 along the outer surface thereof.

FIG. 4, which shows a broken front sectional view of one end of the crib, also shows how the end portion 34 of the side rail extends through one or more apertures 26 in the sidewall 14 to sidably support the sidewall thereon. The end portion 34 preferably extends beyond the sidewall 14 to a mounting bracket 17 or similar retention feature supported on a crib leg 15. Particularly with the use of a compressional spring 40 interposed between the bracket 17 and the sidewall 14, the sidewall is supported at its lower descendable limit such that it neither slides off the end portion 34 of the side rail 16 nor comes to an abrupt impacting stop against bracket 17 when it is descended. The retention portion 32 of the side rail 16 traverses the thickness of the endwall 12 through apertures 20 and 22, from the start of groove 21 in the outer surface of the endwall to the washer 24 proximate the inner surface 13*a* of the endwall. In this manner the retention portion 32 is securely retained relative to the endwall 12. The retention portion 32 preferably also projects beyond the inner surface of the endwall to provide some clearance between the end portion 34 of the side rail 16 and the inner surface 13*a* of the endwall 12.

Figure 8:
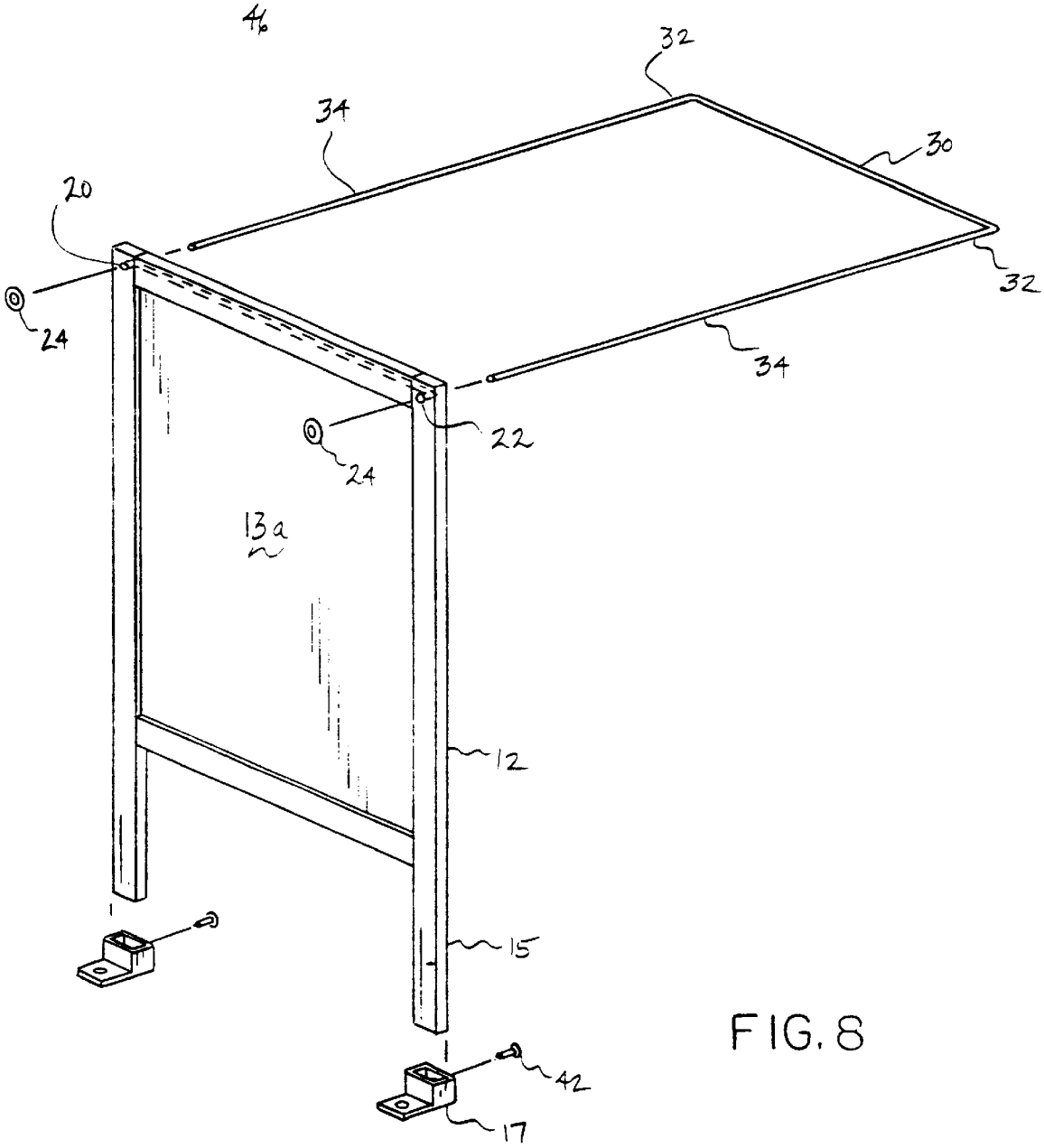
FIG. 8 is a pre-assembly schematic view of the crib of FIG. 1.
Figure 9:
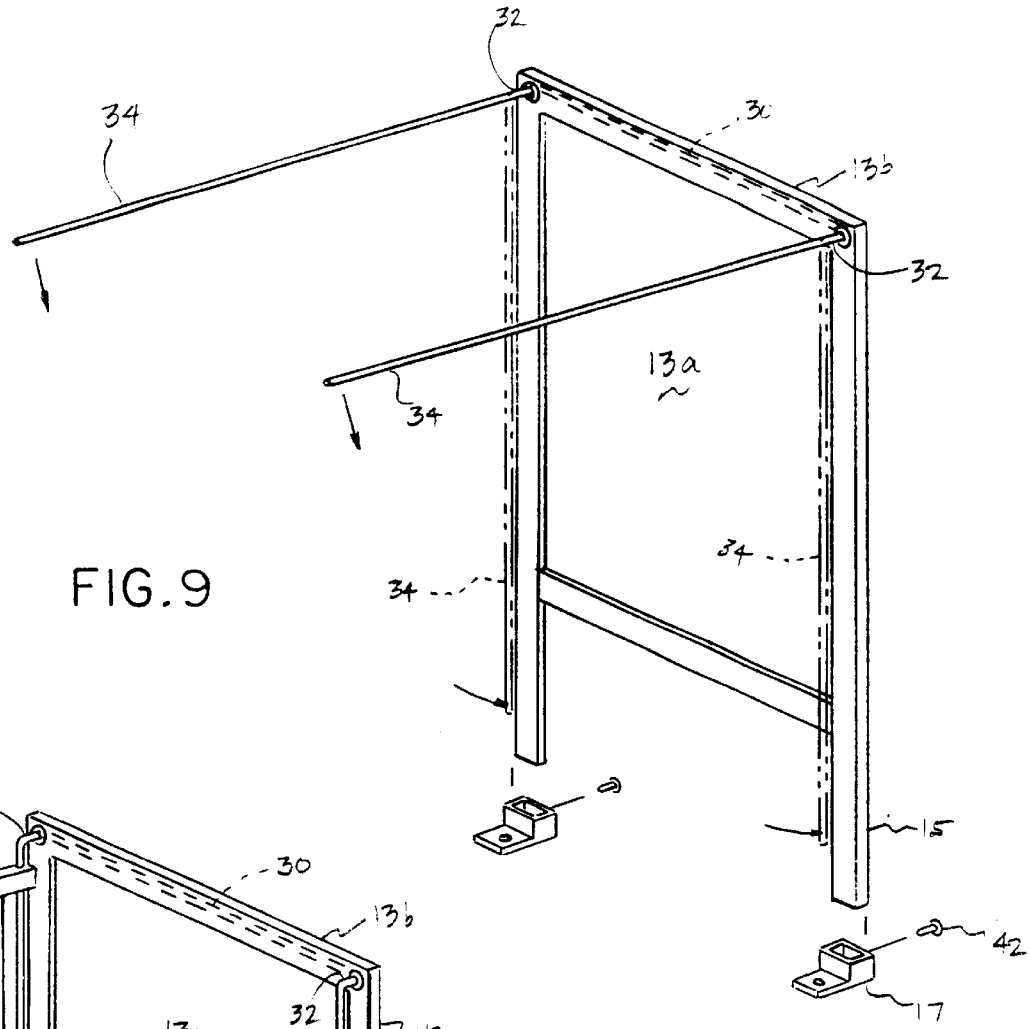
FIG. 9 is a mid-assembly schematic view of the crib of FIG. 1.
Figure 10:
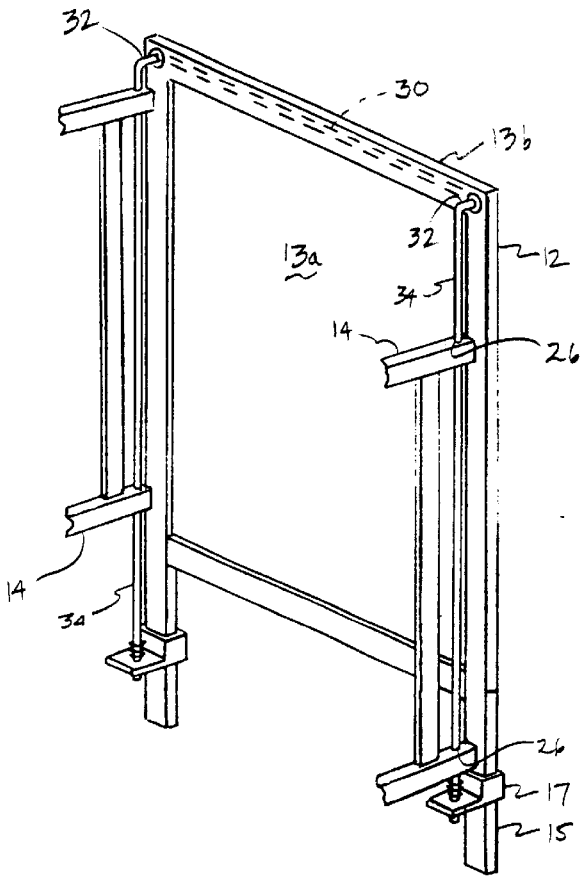
FIG. 10 is a post-assembly schematic view of the crib of FIG. 1.

FIGS. 8–10 show a method for assembling the crib 10 of FIG. 1. A general U-shaped crib side rail having a central portion 30 and adjacent retention 32 and end 34 portions collinearly disposed on each side thereof at substantially a right angle thereto is inserted in the manner shown through first and second apertures 20 and 22 in endwall 12 from the outer surface 13*b* toward the inner surface 13*a*. The U-shaped side rail is inserted until the central portion 30 is flush into the groove 21 (shown in FIGS. 4–6) in the outer surface 13*b* of the endwall 12. This leaves the retention portion 32 of the side rail partially disposed in apertures 20 and 22 and partially extending slightly inwardly therefrom while end portions 34 extend completely inwardly of the endwall 12. Washers 24 are then preferably circumscribed about the ends of the side rail and slid into position abutting the inner surface 13*a* of the endwall 12, or into a recess on the inner surface 13*a*.

Progressing to FIG. 9, downward force is then applied to the ends of the side rail while the retention portion 32 of the side rail is held in place such that the end portion 34 bends approximately 90° relative to the retention portion 32 and becomes generally parallel with the legs 15 of the crib. In this manner, the portion of the retention portion 32 protruding from the apertures 20 and 22 defines a clearance space between the generally parallel end portions 34 of the side rail 16 and the endwall 12.

Figure 7:
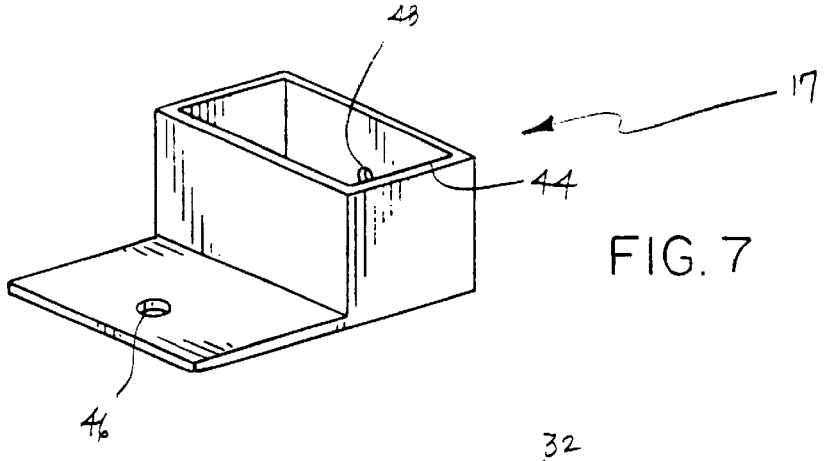
FIG. 7 is a perspective view of a lower bracket of the crib of FIG. 1.

As seen in the progression from FIG. 9 to FIG. 10, the sidewall 14 has a pair of apertures 26 therein and is slid onto the side rail, with heliacal spring 40 slid onto the side rail thereafter. Mounting bracket 17 (shown in detail in FIG. 7) is then slid onto the leg 15 of the crib by circumscribing leg aperture 44 of the mounting bracket around leg 15. When oriented properly thereon, the side rail aperture 46 of the mounting bracket will align with the end of the side rail such that it is slid into contact with the spring 40. When the mounting bracket 17 is at an appropriate lower limit height for the ascendable sidewall 14, a mounting screw 42 is inserted into the screw aperture 48 of the mounting bracket 17 and screwed therethrough and into the leg 15 of the crib to securely affix it thereto.

Since a single side rail 16 provides slidable support for one side of a sidewall 14 at one of its ends and support for another such descendable sidewall 14 at the other of its ends, a pair of side rails disposed as such at opposite endwalls provides two-sided support for both descendable sidewalls 14.

From the foregoing description and figures it can be clearly seen that far greater resistance to mechanical failure is provided in the inventive crib. While the designs shown in FIGS. 2 and 3 are prone to hazardous conditions upon the simple failure of a screw, bolt head, or the like, no such failure is possible with the inventive crib. In particular, the central portion 30 of the side rail 16 fitting tightly into the groove 21 on the outer surface 13*b* of the endwall 12 will provide substantially greater resistance to forces pulling the side rail 16 inwardly toward the center of the crib. In particular, the crib side rail would likely have to fail in tension, a very unlikely proposition due to the high yield strength of metal, in order for additional spacing to be introduced between the end portion 34 of the side rail and the inner surface 13*a* of the endwall 12. This is the type of spacing which according to the U.S. Consumer Product Safety Commission's report is extremely hazardous and has resulted in many injuries and deaths.

Figure 11:
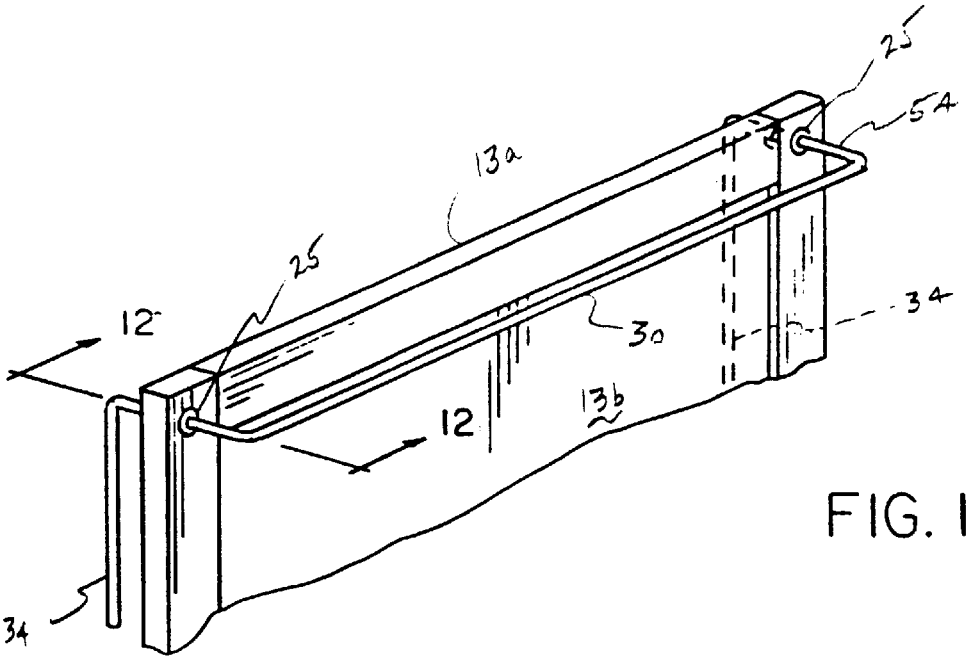
FIG. 11 is a broken perspective view of a crib in accordance with an alternative embodiment of the invention.
Figure 12:
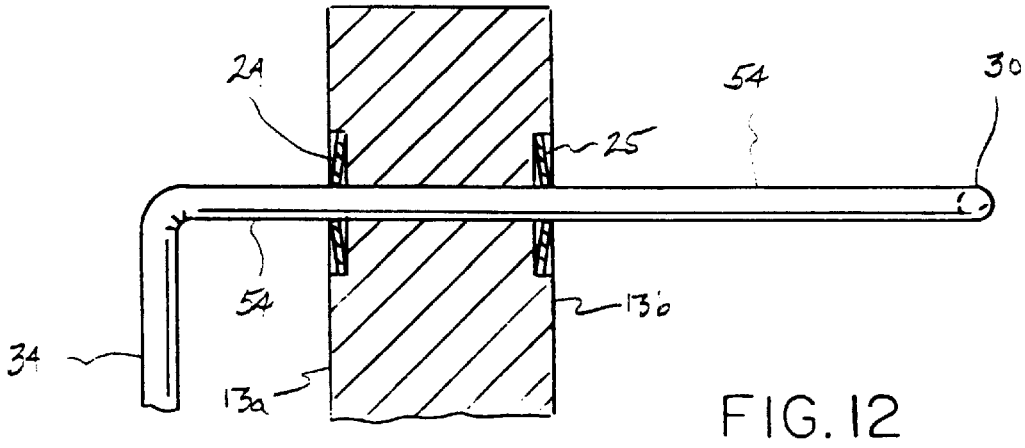
FIG. 12 is a front cross-sectional view of the crib of FIG. 11 taken along the line 12—12.

FIGS. 11 and 12 show an alternative embodiment of the inventive crib wherein the central portion 30 does not fit tightly within a groove 21 on the outer surface 13*b* of the endwall 12. Rather, the retention portion 54 of the side rail in this embodiment protrudes from apertures 20 and 22 not only inwardly toward end portion 34 but also outwardly toward central portion 30. This provides some clearance between the central portion 30 and the outer surface 13*b* of the endwall 12. Due to this additional clearance, an extra set of washers 25 is also introduced in the assembly process to provide additional resistance to the retention portion 54 sliding in either direction through the apertures 20 and 22. Although this embodiment may have lower resistance to the types of failure forces discussed above relative to the previously described and illustrated embodiment, it may still have greater resistance to failure than do prior art designs due to the double washer and single rail configuration. Also, the additional clearance provided by the elongated retention portion 54 of the alternative embodiment may provide additional functionality, such as providing a rack for hanging towels, blankets, diapers, or the like.

The assembly of the embodiment of FIGS. 11 and 12 is similar to the assembly of the previously described embodiment except that washers 25 are circumscribed on the legs of the U-shaped side rail prior to its bending and insertion through apertures 20 and 22 and in that the U-shaped side rail is not inserted all the way until the central portion 30 abuts either the outer surface 13*b* of the endwall 12 or the groove 21 therein. Rather, the insertion is completed when the central portion 30 is generally parallel to the outer surface 13*b* and retains a predetermined clearance with respect thereto. This predetermined clearance should also allow for a predetermined clearance between the end portion 34 of the side rail and the inner surface 13*a* of the endwall once the end portion 34 is bent perpendicularly to the retention portion 54.

It should be noted that the above-described and illustrated embodiments of the invention are not an exhaustive listing of the forms a crib in accordance with the invention could take; rather, they serve as exemplary and illustrative of preferred embodiments of the invention as presently understood. For example, the inventive crib may have only one descendable sidewall, rather than two. In this case, the central portion 30 of the side rail 16 would just be a bent portion behind the endwall 12 and would not necessarily traverse the width of the endwall. Many other forms of the invention are believed to exist.

What is claimed is:

1. A crib comprising:

a pair of generally vertical endwalls and a pair of generally vertical sidewalls, at least one of said sidewalls being descendable to facilitate placing a child into and removing said child from said crib over said descendable sidewall, said descendable sidewall having opposing ends, one of said opposing ends adjoining one of said pair of endwalls and the other of said opposing ends adjoining the other of said pair of endwalls;

a generally horizontal mattress support extending between at least two of said endwalls and sidewalls;

a leg disposed proximately to where said descendable sidewall adjoins said one of said pair of endwalls and a leg disposed proximately to where said descendable sidewall adjoins said other of said pair of endwalls, said legs for supporting said crib above a generally flat surface and for providing clearance between said crib and said generally flat surface such that said descendable sidewall is descendable toward said flat surface relative to said endwalls; and a crib side rail for slidably supporting said descendable sidewall of said crib thereon between said endwalls, said crib side rail being securely retained relative to said endwall by having a portion thereof disposed through an aperture in said endwall and by having a rear portion thereof bent behind said aperture.

2. A crib in accordance with claim 1 further comprising a second crib side rail for slidably supporting said descendable sidewall of said crib between said endwalls, wherein one of said crib side rails is securely retained relative to one of said endwalls by having a portion thereof disposed through an aperture in said one of said sidewalls and by having a rear portion thereof bent behind said aperture of said one of said sidewalls and the other of said crib side rails is securely retained relative to the other of said endwalls by having a portion thereof disposed through an aperture in said other of said sidewalls and by having a rear portion thereof bent behind said aperture of said other of said sidewalls.

3. A crib in accordance with claim 1 wherein said endwall includes a groove on its rear surface for accommodating said rear portion of said crib rail therein.

4. A crib in accordance with claim 1 further comprising a mounting bracket slidably mountable on one of said legs for retaining an end of said crib side rail.

5. A crib in accordance with claim 1 wherein said rear portion of said crib side rail extends beyond said endwall to provide clearance therebetween.

6. A method for assembling a crib, said method comprising the steps of:

providing a generally bent rail having a rear portion and at least one end portion generally perpendicular to said rear portion, an endwall having an aperture there through suitably sized to receive said rail there through, said endwall having a leg extending therefrom, a sidewall having at least one aperture there through suitably sized to receive said rail there through, and a mounting bracket;

inserting said end portion of said rail through said aperture of said endwall;

sliding said end portion of said rail through said aperture until said rear portion of said rail attains a predetermined distance from said endwall and is generally parallel thereto;

bending said end portion of said rail approximately 90° such that it is generally parallel to said leg;

aligning said sidewall aperture with said bent end portion of said rail;

threading said sidewall onto said bent end portion of said rail;

translating said mounting bracket along said leg and then simultaneously along said leg and said bent end portion of said rail; and affixing said mounting bracket relative to said leg.

7. A method in accordance with claim 6 further comprising the step of applying a stop washer over said end portion of said rail where it emerges from said endwall aperture between the sliding and bending steps.

8. A crib comprising:

a pair of generally vertical endwalls and a pair of generally vertical sidewalls extending between said endwalls, each of said sidewalls being descendable to facilitate placing a child into and removing said child from said crib over one of said descendable sidewalls;

a generally horizontal mattress support extending between at least two of said endwalls and sidewalls;

a leg disposed proximately lo where each descendable sidewall adjoins each endwall, said legs for supporting said crib above a generally flat surface and for providing clearance between said crib and said generally flat surface such that said descendable sidewalls are descendable toward said flat surface relative to said endwalls; and a pair of crib side rails for slidably supporting said descendable sidewalls of said crib thereon between said endwalls, each of said pair of crib side rails being associated with one of said pair of endwalls such that it is retained between a pair of apertures therein, each of said crib side rails having a central portion retained behind said associated endwall, a pair of retention portions retained in said apertures of said associated endwall, and a pair of end portions each for slidably supporting one end of one of said descendable sidewalls.

9. A crib in accordance with claim 8 wherein each of said endwalls includes a groove on its rear surface for accommodating said central portion of said crib rail therein.

10. A crib in accordance with claim 8 further comprising a mounting bracket slidably mountable on each of said legs for retaining an end portion of one of said crib side rails.

11. A crib in accordance with claim 8 wherein said central portion of at least one of said crib side rails extends beyond said associated endwall to provide clearance therebetween.

* * * * *

UNITED STATES PATENT AND TRADEMARK OFFICE

CERTIFICATE OF CORRECTION

PATENT NO. : 6,622,322 B1
DATED : September 23, 2003
INVENTOR(S) : Jack E. Caveney It is certified that error appears in the above-identified patent and that said Letters Patent is hereby corrected as shown below:

Title page,
Item [56], References Cited: OTHER PUBLICATIONS,
The following reference should be included:
Consumer Product Safety Commission Document #5025 (2pags.) entitled "CPSC Warns Parents About Infant Strangulations Caused by Failure of Crib Hardware."

Column 8,
Line 9, "lo" should be -- to --.

Signed and Sealed this

Eighth Day of June, 2004

JON W. DUDAS
*Acting Director of the United States Patent and Trademark Office*